US006120125A

United States Patent [19]

Kim

[11] Patent Number: 6,120,125

[45] Date of Patent: Sep. 19, 2000

[54] TECHNIQUE FOR TESTING THE DRIVING OF NOZZLES IN AN INK-JET PRINTER

[75] Inventor: Jung Hwan Kim, Seoul, Rep. of Korea

[73] Assignee: SamSung Electronics Co., Ltd., Suwon, Rep. of Korea

[21] Appl. No.: 08/928,066

[22] Filed: Sep. 11, 1997

[30] Foreign Application Priority Data

Sep. 17, 1996 [KR] Rep. of Korea ..... 96-40398

[51] Int. Cl.[7] ..... B41J 29/393

[52] U.S. Cl. ..... 347/19

[58] Field of Search ..... 347/19, 14, 23, 347/7

[56] References Cited

U.S. PATENT DOCUMENTS

| | | | |
|---|---|---|---|
| 4,590,482 | 5/1986 | Hay et al. | 347/19 |
| 4,907,013 | 3/1990 | Hobbard et al. . | |
| 4,996,487 | 2/1991 | McSparran et al. . | |
| 5,206,668 | 4/1993 | Lo et al. . | |
| 5,319,389 | 6/1994 | Ikeda et al. . | |
| 5,418,558 | 5/1995 | Hock et al. . | |
| 5,422,664 | 6/1995 | Stephany | 347/19 |
| 5,428,376 | 6/1995 | Wade et al. . | |
| 5,521,620 | 5/1996 | Becerra et al. . | |
| 5,526,027 | 6/1996 | Wade et al. . | |
| 5,539,434 | 7/1996 | Fuse . | |
| 5,576,745 | 11/1996 | Matsubara . | |
| 5,608,333 | 3/1997 | Hayashi . | |
| 5,617,121 | 4/1997 | Tachihara et al. | 347/7 |
| 5,627,572 | 5/1997 | Harrington, III et al. . | |
| 5,638,097 | 6/1997 | Takayanagi et al. . | |

*Primary Examiner*—John E. Barlow, Jr.
*Assistant Examiner*—Charles W. Stewart, Jr.
*Attorney, Agent, or Firm*—Robert E. Bushnell, Esq.

[57] ABSTRACT

An apparatus for testing the driving of nozzles in an ink-jet printer having a plurality of nozzles for spreading ink and a nozzle driving unit for driving the nozzles by receiving a nozzle driving signal, includes: a nozzle drive detecting unit for detecting the variation of the voltage generated by the nozzle driving unit as the nozzles are driven, and for generating the predetermined detecting signal; a control unit for generating successively the nozzle driving signal fed to the nozzle driving unit, and for testing the driving state and finding defective nozzles when the detecting signal is inputted; and a result outputting unit for informing the user of the testing result performed in the control unit. It is possible for a user to take necessary actions according to the testing result, by informing the user of the number of defective nozzles which are found via the testing for the driving state of the nozzles instead of finding a defect manually.

17 Claims, 4 Drawing Sheets

TECHNIQUE FOR TESTING THE DRIVING OF NOZZLES IN AN INK-JET PRINTER

CLAIM OF PRIORITY

This application makes reference to, incorporates the same herein, and claims all benefits accruing under 35 U.S.C. §119 from an application for APPARATUS AND METHOD FOR TESTING THE DRIVING OF NOZZLES IN AN INK-JET PRINTER earlier filed in the Korean Industrial Property Office on the of Sep. 17, 1996 and there duly assigned Ser. No. 40398/1996.

BACKGROUND OF THE INVENTION

1. Field of the Invention

The present invention relates to for testing the driving of nozzles in an ink-jet printer which is capable of informing a user of a defect of a nozzle or the number of defective nozzles, by testing the driving state of each nozzle through the variation of the voltage generated by a nozzle driving unit when the nozzles are driven successively.

2. Description of the Related Art

An ink-jet printer is an apparatus which records data by spreading ink on a paper. The ink-jet printer includes a printer head having a number of nozzles for spreading ink, and the printer head is usually located in an ink cartridge where ink is stored.

Such a printer includes a nozzle driving unit for driving a number of nozzles of the printer head. The nozzle driving unit drives the nozzles by receiving a nozzle driving signal generated by a control unit.

Exothermic resistances for heating the ink of each nozzle in the printer head are provided. Each of the exothermic resistances is connected in series with each of the respective nozzle driving transistors. The exothermic resistances are connected to a head driving power supply having a power supply voltage of 24 volts, for example, by means of separate resistances for each group.

The nozzle driving transistors are turned on as the nozzle driving signal generated by the control unit is supplied to each base terminal of the driving transistors. As a result, the exothermic resistance corresponding to the turned on transistor is provided with a current to generate heat.

Due to the heat generated, ink is heated, and in turn, bubbles are produced. As the bubbles expand, ink spurts out of the nozzle to produce a dot on paper.

The ink-jet printer drives a carriage return motor and moves the ink cartridge to the right and left to produce a multiplicity of dots on a paper to form a word or a graphic.

However, when the ink cartridge is used for a long time, the circuit of the nozzle driving unit which is electrically sensitive can be damaged, and the quality of printing is lowered, as ink is not spread from some nozzles.

In these cases, in order to test for the driving state of the nozzles, a user can confirm the printing state by outputting a test pattern of a predetermined form, via an application program for nozzle testing which is performed in a computer or a self test program provided in the printer itself. However, these methods have disadvantages in that the user must know the operation method of the test program and the user must manually confirm the driving state of the nozzles.

The patent to Ikeda et al., U.S. Pat. No. 5,319,389, entitled Method Of Abnormal State Detection For Ink Jet Recording Apparatus, discloses a method in which the resistance of the heating resistors for the nozzles are measured to determine abnormalities therein.

The patent to Hayashi, U.S. Pat. No. 5,608,333, entitled Method Of Driving Heating Element To Match Its Resistance, Thermal Printer, And Resistance Measuring Device, discloses a method in which the resistance value of each heating element in a thermal printer is indirectly measured.

The patent to McSparran et al., U.S. Pat. No. 4,996,487, entitled Apparatus For Detecting Failure Of Thermal Heaters In Ink Jet Printers, measures the resistance of the resistive heater element in a printer and generates a failure signal when a resistance is determined to be above a preselected value.

The following additional patent each disclose features in common with the present invention but are not as pertinent as the patents noted in detail above: U.S. Pat. No. 5,521,620 to Becerra et al., entitled Correction Circuit For An Ink Jet Device To Maintain Print Quality, U.S. Pat. No. 4,907,013 to Hubbard et al., entitled Circuitry For Detecting Malfunction Of Ink Jet Printhead, U.S. Pat. No. 5,206,668 to Lo et al., entitled Method And Apparatus For Detecting Ink Flow, U.S. Pat. No. 5,428,376 to Wade et al., entitled Thermal Turn On Energy Test For An Inkjet Printer, U.S. Pat. No. 5,418,558 to Hock et al., entitled Determining The Operating Energy Of A Thermal Ink Jet Printhead Using An Onboard Thermal Sense Resistor, U.S. Pat. No. 5,627,572 to Harrington III et al., entitled Programmable Head Type Detection And Maintenance System, U.S. Pat. No. 5,539,434 to Fuse, entitled Ink Jet Recording Apparatus And Method Therefor, U.S. Pat. No. 5,526,027 to Wade et al., entitled Thermal Turn On Energy Test For N Inkjet Printer, U.S. Pat. No. 5,638,097 to Taskayanagi et al., entitled Recording Apparatus To Which Recording Head Is Detachably Mounted, and U.S. Pat. No. 5,576,745 to Matsubara, entitled Recording Apparatus Having Thermal Head And Recording Method.

While each of the aforecited patents disclose features in common with the present invention, none of these patents teaches or suggests the specifically recited technique for testing the driving of nozzles in an ink-jet printer in accordance with the present invention.

SUMMARY OF THE INVENTION

Therefore, it is an object of the present invention to provide a technique for testing the driving of nozzles in an ink-jet printer. The apparatus according to the present invention tests the driving of each nozzle by sensing the variation of the voltage generated by a nozzle driving unit when the nozzles are driven successively. Moreover, by informing a user of any defective nozzle and the number of defective nozzles, the user can easily test the driving state of the nozzles without a direct test pattern being performed manually. The apparatus for testing the driving of nozzles in an ink-jet printer having a plurality of nozzles for spreading ink and a nozzle driving unit for driving the nozzles by receiving a nozzle driving signal, further includes a nozzle drive detecting unit for detecting the variation of the voltage generated by the nozzle driving unit as the nozzles are driven, and for generating a predetermined detecting signal; a control unit for generating successively the nozzle driving signal to the nozzle driving unit, and for testing the driving state and finding defective nozzles when the detecting signal is inputted; and a result outputting unit for informing the user of the testing result performed in the control unit.

Additionally, the apparatus for testing the driving of nozzles and having a nozzle driving unit for driving the nozzles; the nozzle drive detecting unit generating the predetermined detecting signal by detecting the variation of the voltage generated by the nozzle driving unit; and a nozzle counter for indicating the number of the nozzles successively, includes: an initializing step for initializing the nozzle counter; a nozzle testing step for counting increasingly the value of the nozzle counter in order, testing whether the detecting signal is generated in response to each nozzle by driving the nozzle which is indicated by the count value of the nozzle counter, and making the list of defective nozzles by storing the count value in an information storing unit when the detecting signal is not generated; and a result outputting step for informing the user by displaying the list of the defective nozzles to the result outputting unit when the testing of the nozzles has been completed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The objects, characteristics and advantages of the above-described invention will be more clearly understood referring to the attached drawings.

Figure 1:
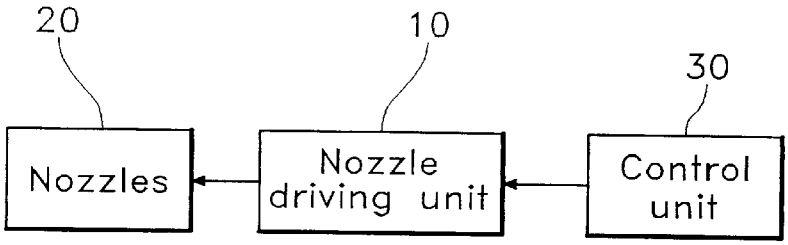
Fig. 1 (Prior Art)
FIG. 1 is a block diagram of a conventional ink-jet printer.

As shown in FIG. 1, the printer includes a nozzle driving unit 10 for driving a number of nozzles of the printer head, and the nozzle driving unit 10 drives the nozzles 20 by receiving a nozzle driving signal generated by a control unit 30.

Figure 2:
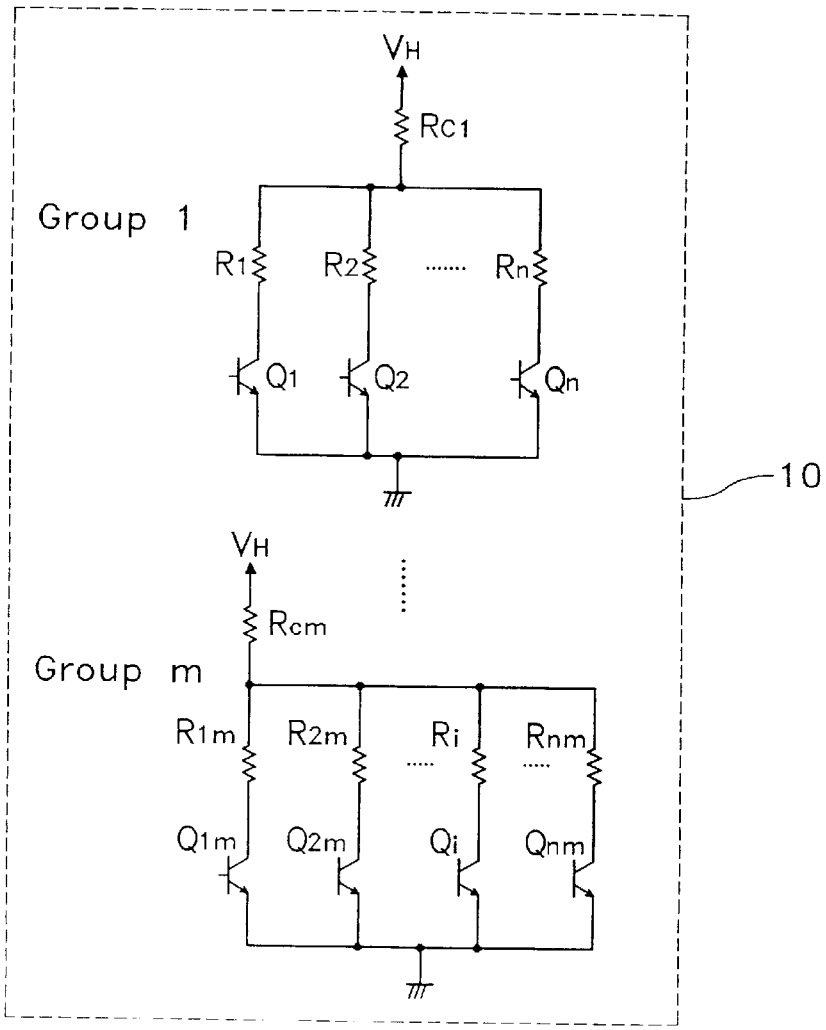
Fig. 2 (Prior Art)
FIG. 2 is a circuit diagram of a nozzle driving unit of the conventional ink-jet printer.

FIG. 2 is a circuit diagram of the nozzle driving unit 10, and it shows the circuit for driving 'm' number of groups having 'n' number of nozzles each.

Exothermic resistances for heating the ink of each nozzle in the printer head are provided. As shown in FIG. 2, each of the exothermic resistances $R_1$ through $R_{nm}$ is connected in series with each of the respective nozzle driving transistors $Q_1$ through $Q_{nm}$. The exothermic resistances $R_1$ through $R_{nm}$ are connected to a head driving power supply $V_H$ having a power supply voltage of 24V by means of resistances $R_1$ through $R_{cm}$.

The nozzle driving transistors are turned on as the nozzle driving signal generated by the control unit is supplied to each base terminal of the driving transistors. As a result, the exothermic resistance corresponding to the turned-on transistor is provided with a current to generate heat. For example, out of nozzle driving transistors $Q_1$ through $Q_{nm}$, when the $i^{th}$ transistor $Q_1$ within the $m^{th}$ nozzle group is turned on in accordance with the nozzle driving signal, the exothermic resistance $R_1$ which is connected to the $i^{th}$ transistor, is then provided with a current generated by a head driving power supply $V_H$ through the resistance $R_{cm}$ for generating heat.

Figure 3:
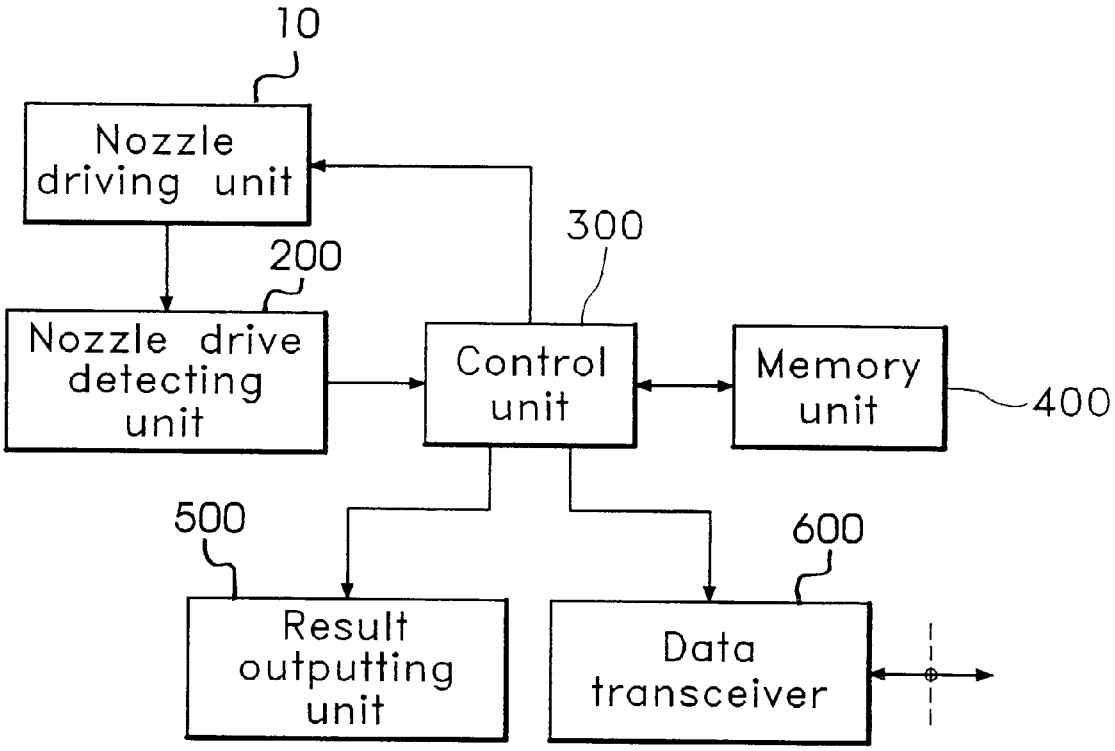
FIG. 3 is a block diagram of an apparatus for testing the driving of nozzles in an ink-jet printer according to the present invention.

FIG. 3 is a block diagram roughly showing the construction of an apparatus for testing the driving of nozzles in an ink-jet printer according to the present invention. As shown in the drawing, the apparatus for testing the driving of nozzles includes a nozzle driving unit 10; a nozzle drive detecting unit 200 which generates a predetermined detecting signal RD-NOZ by detecting the variation of the voltage generated by the nozzle driving unit 10; a control unit 300 which successively generates a nozzle driving signal to the nozzle driving unit 10, and tests separately the driving state of each nozzle by receiving the detecting signal RD-NOZ from the nozzle drive detecting unit 200; a memory unit 400 which stores the results tested by the control unit 300; and a result outputting unit 500 which displays the testing results stored in the memory unit 400.

Here, the control unit 300 includes a nozzle counter which is increasingly incremental and indicates the number of each nozzle successively. The result outputting unit 500 may be an LCD panel and is provided on a panel of the printer.

Additionally, a data transceiver 600 for transmitting/receiving data to/from the computer is further provided.

Figure 4:
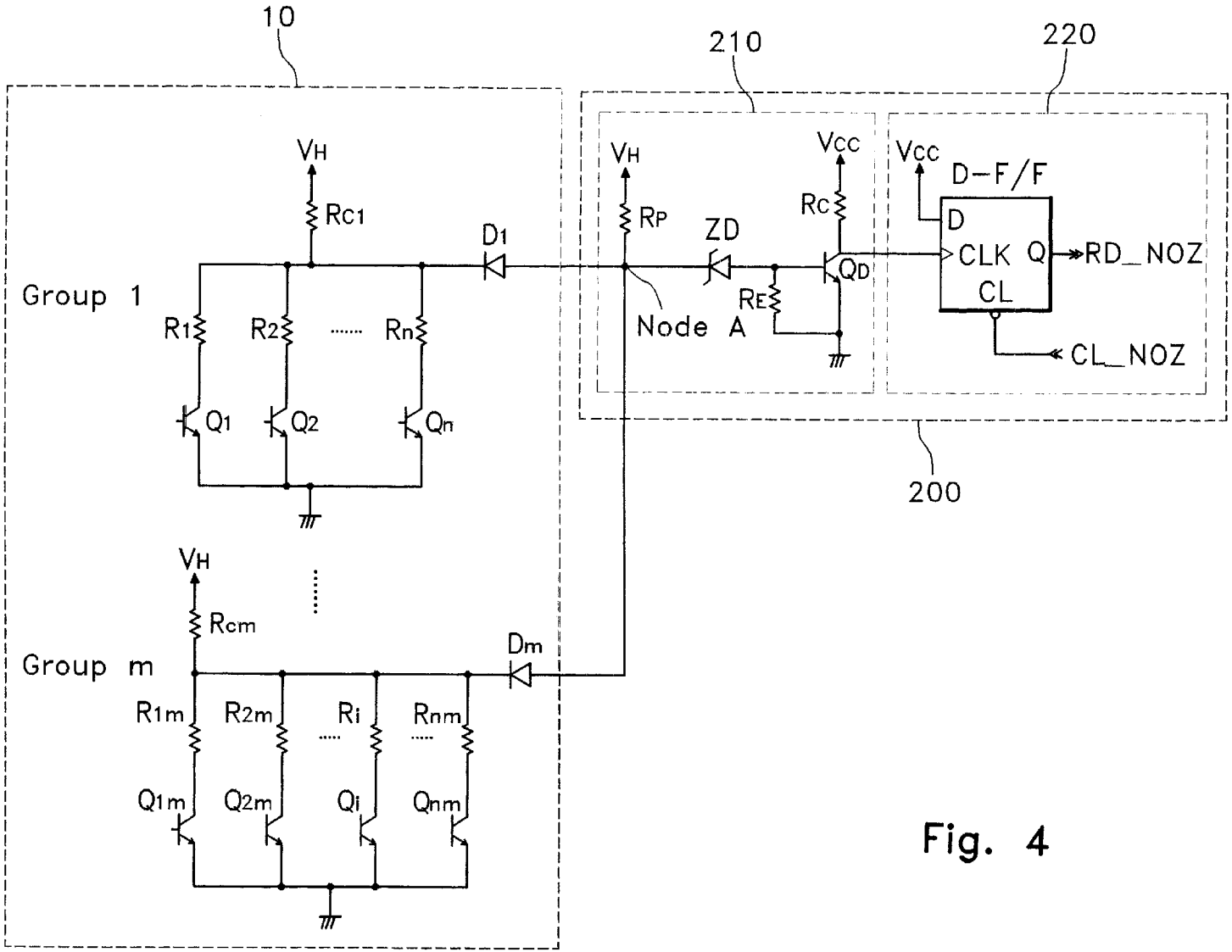
FIG. 4 is a circuit diagram of a nozzle drive detecting unit of the apparatus for testing the driving of nozzles in an ink-jet printer according to the present invention.

FIG. 4 is a circuit diagram showing a nozzle drive detecting unit of the apparatus for testing the driving of nozzles according to the present invention.

As shown in FIG. 4, the nozzle drive detecting unit 200 includes a nozzle drive sensing unit 210 for sensing the variation of the voltage outputted to an output terminal (node A) of the nozzle driving unit 10; and a detecting signal generating unit 220 for generating a predetermined detecting signal RD-NOZ outputted to the control unit 300 when the driving of the nozzle is sensed via the nozzle drive sensing unit 210.

Here, the nozzle drive sensing unit 210 includes a zener diode ZD having a cathode terminal connected to the nozzle driving voltage $V_H$ through the resistance $R_P$; and an NPN transistor $Q_D$ having a base terminal connected to an anode terminal of the zener diode ZD. As the transistor $Q_D$ has a base terminal and an emitter terminal which are both connected to a resistance $R_E$, it is switched by the voltage applied across both terminals. As a collector terminal is connected to a logic circuit power supply $V_{CC}$ having a power supply voltage of 5V via a resistance $R_C$, the voltage of the collector terminal is changed as the transistor $Q_D$ is switched.

Moreover, the cathode terminal of the zener diode ZD is commonly connected to anode terminals of diodes $D_1$ to $D_m$. As the cathode terminals of diodes $D_1$ to $D_m$ are connected to respective connecting points which are commonly connected to exothermic resistances $R_1$ to $R_{nm}$, they carry the variation of the voltage of the nozzle driving unit 10 to the nozzle drive sensing unit 210 and prevent the intervention between the nozzle groups.

The detecting signal generating unit 220 includes a data flip-flop D-F/F (which will be referred to as a D flip-flop) having a clock input signal CLK connected to the collector terminal of the transistor $Q_D$ and having a data input terminal D connected to the logic circuit power supply $V_{CC}$. An output terminal Q and a clear terminal CLR are connected to the control unit 300, and the output terminal Q generates a predetermined detecting signal RD-NOZ fed to the control unit 300. The clear terminal CLR receives a clear signal CL-NOZ generated by the control unit 300, and resets the D flip-flop D-F/F.

Figure 5:
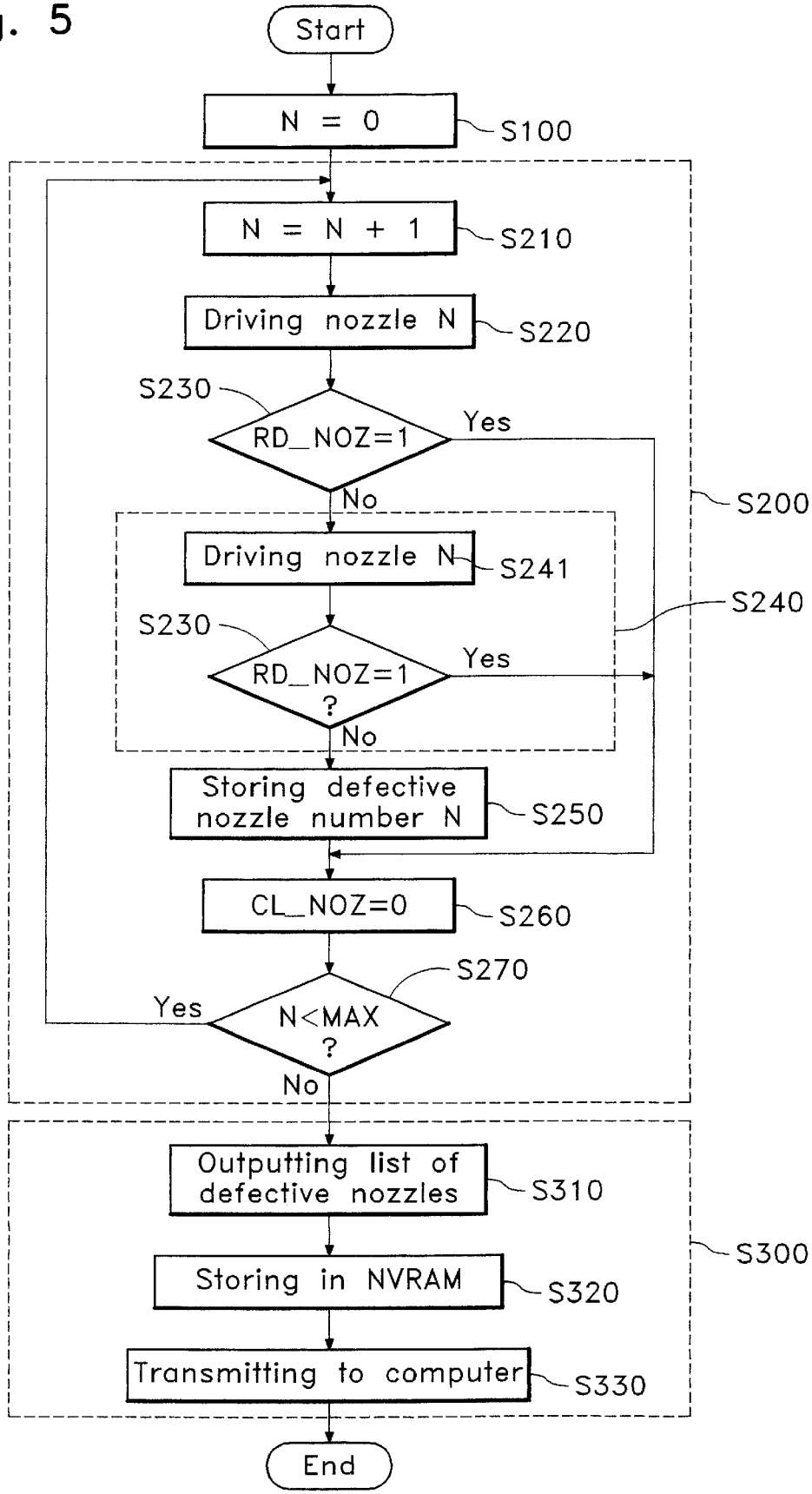
FIG. 5 is a flowchart of a sequence for testing the driving of nozzles in the ink-jet printer according to the present invention.

FIG. 5 is a flowchart showing a sequence for testing the driving of nozzles in the ink-jet printer according to the present invention.

Referring to FIG. 5, the method for detecting the driving of nozzles according to the present invention includes an initializing step S100 for initializing the nozzle counter; a nozzle testing step S200 for incrementing increasingly the value of the nozzle counter, testing whether the detecting signal RD-NOZ is generated by the nozzle drive detecting unit in response to each nozzle by driving the nozzle which is indicated by the count value of the nozzle counter, and making a list of defective nozzles by storing the count value in the memory unit 400 when the detecting signal RD-NOZ is not generated; and a result outputting step S300 for informing a user of the results by displaying the list of the defective nozzles stored in the memory unit 400 to the result outputting unit 500.

Here, in the nozzle testing step 200, when the detecting signal RD-NOZ is not generated by the nozzle drive detecting unit 200, the nozzle indicated by the nozzle counter is driven again and it is tested whether the detecting signal RD-NOZ is generated. On the other hand, when the detecting signal RD-NOZ is generated, the clear signal CL-NOZ is generated in the nozzle drive detecting unit 200.

The result outputting step S300 includes a transmission outputting step S330 for outputting the list of the defective nozzles stored in the memory unit 400 to the computer via the data transceiver 600.

The operation and function of the present invention having the above-described construction is as follows.

First, when power is supplied to the ink-jet printer, the power is provided to each part of the printer including the nozzle driving unit 10 and the nozzle drive detecting unit 200. The zener diode ZD of the nozzle drive sensing unit 210 is turned on, as voltage higher than the zener voltage is applied reversely. The transistor $Q_D$ is turned on and the electrical potential of the collector terminal is a voltage of a low level (LOW:L). Moreover, the output terminal Q of the D flip-flop D-F/F also has a voltage of a low level (L).

In the aforesaid state, the control unit 300 initializes the count value of the nozzle counter to "0". (S100)

The count value of the nozzle counter increases by one (1), and the nozzle drive driving signal for driving the nozzle which is indicated by the nozzle counter is generated and fed to the nozzle driving unit 10. (S210 and S220)

Here, as the count value of the nozzle counter is "1", the nozzle driving signal is supplied to a base terminal of the first nozzle driving transistor $Q_1$ out of the nozzle driving transistors $Q_1$ through $Q_{nm}$ of the nozzle driving unit 10, and the first nozzle driving transistor $Q_1$ is turned on. The power supply $V_H$ for driving the head is applied to exothermic resistance $R_1$, in order to generate heat. At this time, as the ink cartridge is located in a parking area inside of the ink-jet printer for preventing the ink from drying, the ink which spurts out when the nozzles start to operate is treated in this area.

After that, the diode $D_1$ of the nozzle driving unit 10 is turned on, as the electrical potential of the anode terminal is higher than that of the cathode terminal. The zener diode ZD is shut off as voltage lower than the zener voltage is applied reversely and the transistor $Q_D$ is turned off. As a result, the level of the electrical potential of the collector terminal of the transistor $Q_D$ changes from low to high.

In the control unit 300, when the nozzle driving signal which is provided to the nozzle driving unit is shut off, the nozzle driving transistor $Q_1$ is turned off as well. Therefore, as the electrical potential of the cathode terminal is higher than that of the anode terminal, the diode $D_1$ of the nozzle driving unit 10 is turned off. The zener diode ZD is turned on as voltage higher than the zener voltage is applied reversely again and the transistor $Q_D$ is turned on. As a result, the level of the electrical potential of the collector terminal of the transistor $Q_D$ changes from high to low.

As one nozzle is in operation, the electric potential of the collector terminal of the transistor $Q_D$ changes to generate a clock pulse. This clock pulse is inputted to the clock input terminal CLK of the D flip-flop D-F/F. As a result, the D flip-flop D-F/F having a data input terminal D connected to the logic circuit power supply $V_{CC}$ outputs a voltage of a high level to the output terminal Q, thereby generating the detecting signal RD-NOZ.

When the control unit 300 receives the detecting signal RD-NOZ from the D flip-flop D-F/F, it determines that the driven nozzle is in a proper state and resets the D flip-flop D-F/F by generating the clear signal CL-NOZ fed to the clear terminal CLR of D flip-flop D-F/F. Moreover, the control unit 300 compares the count value of the nozzle counter with the total number of nozzles MAX. When the count value is not greater than or equal to the total number of nozzles, then the nozzle counter continues to increment increasingly the value. (S210, S230, S240 and S270). Thereafter, the control unit 300 drives the next nozzle by generating the nozzle driving signal fed to the nozzle driving unit 10 for driving the nozzle indicated by the nozzle counter. (S210 and S220)

As described above, the nozzle driving signal for driving the corresponding nozzle in accordance with the count value of the nozzle counter which increases successively is outputted to the nozzle driving unit 10, and all the nozzles are successively driven. Accordingly, the nozzle driving state can be tested by determining whether or not the detecting signal RD-NOZ is generated by the D flip-flop D-F/F.

However, if there is a defect in $i^{th}$ nozzle, there would not be a change in the electrical potential of the node A when the nozzle driving signal is sent to the nozzle driving transistor $Q_i$. Consequently, a clock pulse would not reach the clock input terminal CLK of the D flip-flop D-F/F. As a result, the detecting signal RD-NOZ is not generated in the output terminal Q of the D flip-flop D-F/F.

When the detecting signal RD-NOZ is not generated by the D flip-flop D-F/F, although the nozzle driving signal is generated, the control unit 300 generates the nozzle driving signal for driving the $i^{th}$ nozzle which is indicated by the nozzle counter and fed to the nozzle driving unit 10, and tests again whether the detecting signal RD-NOZ is generated by the D flip-flop D-F/F. (S230, S241 and S242)

At this time, when the detecting signal RD-NOZ is inputted to the control unit 300, the driving state of the $i^{th}$ nozzle is regarded as being normal. On the contrary, when the detecting signal RD-NOZ is not inputted to the control unit 300, the $i^{th}$ nozzle is regarded as being defective. Accordingly, the count value I which is indicated by the nozzle counter is stored in the memory unit 400 and it is included in the list of the defective nozzles. (S242 and S250)

When the test for the driving state of each nozzle is completed, the control unit 300 outputs the list of defective nozzles stored in the memory unit 400 to the result outputting unit 500, and the error message is displayed on an LCD panel. (S310) The list of defective nozzles which is temporarily stored during the testing operation is stored in a non-volatile memory NVRAM provided in the memory device 400 for long-term preservation. The testing results are transmitted to computer via the data transceiver 600. (S320 and S330)

As the testing results transmitted to the computer are treated in a printer driver and outputted to a monitor, the user can confirm the testing results and print them on a paper when necessary. Moreover, whenever a user gives an order, the list of defective nozzles stored in the non-volatile memory is displayed on the result outputting unit 500 and lists the defective nozzles.

As described above, according to the present invention, it is possible for a user to take necessary actions according to the testing result, by informing the user of the number of defective nozzles which are found via the testing for the driving state of the nozzles instead of finding a defect manually.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. An apparatus for testing the driving of nozzles in an ink-jet printer having a plurality of nozzles for spreading ink and a nozzle driver for driving the nozzles by receiving a nozzle driving signal, comprising:

a nozzle drive detector for detecting a variation of a voltage generated by said nozzle driver as the nozzles are driven, and for generating a predetermined detecting signal in response thereto;

a controller including a generator for generating successively the nozzle driving signal fed to said nozzle driver, and for testing the driving state and finding defective nozzles in accordance with the detecting signal inputted thereto from said nozzle drive detector; and a result outputting means for informing a user of a testing result performed by said controller.

2. The apparatus of claim 1, said result outputting means comprising a liquid crystal display panel.

3. The apparatus of claim 1, said result outputting means comprising a printer for printing the testing result on paper.

4. The apparatus of claim 1, further comprising an information storing means for storing the testing result.

5. The apparatus of claim 4, said information storing means comprising a non-volatile memory.

6. The apparatus of claim 1, said controller further comprising a nozzle counter which is increasingly incremented in order and indicates the number of each nozzle successively, and determines that a nozzle is a defective nozzle upon an absence of the detecting signal being generated in response to the nozzle driving signal, and displays the count value indicated by said nozzle counter on said result outputting means.

7. The apparatus of claim 4, said controller further comprising a nozzle counter which is increasingly incremented in order and indicates the number of each nozzle successively, and determines that a nozzle is a defective nozzle upon an absence of the a detecting signal being generated in response to the nozzle driving signal, and forms a list of defective nozzles by storing the count value indicated by said nozzle counter in said information storing means.

8. The apparatus of claim 1, said nozzle drive detector comprising: a nozzle drive sensor for detecting the variation of the voltage generated from said nozzle driver; and a detecting signal generator for setting the voltage detected from said nozzle drive sensor and for generating the predetermined detecting signal.

9. A method of testing the driving of nozzles in an apparatus for testing the driving nozzles in an ink-jet printer having a nozzle driver for driving nozzles; a nozzle drive detector for generating a predetermined detecting signal by detecting a variation of the voltage generated by said nozzle driver; and a nozzle counter for indicating successively the number of the nozzles, the method comprising:

an initializing step of initializing said nozzle counter;

a nozzle testing step for incrementing increasingly the value of said nozzle counter, testing whether the detecting signal has been generated in response to each nozzle by driving the nozzle indicated by the count value of said nozzle counter, and forming a list of defective nozzles by storing the count value in an information storing means upon an absence of the detecting signal being generated; and a result outputting step for informing a user of the results by displaying a list of defective nozzles on said result outputting means.

10. The method of claim 9, said nozzle testing step includes a step of resetting said nozzle drive detector upon an absence of the detecting signal being generated.

11. The method of claim 9, said nozzle testing step includes a step of retesting the nozzle indicated by said nozzle counter upon the detecting signal being generated, by again testing whether the detecting signal has been generated.

12. The method of claim 10, said nozzle testing step includes a step of retesting the nozzle indicated by said nozzle counter upon an absence of the detecting signal being generated, by again testing whether the detecting signal has been generated.

13. The method of claim 9, said result outputting step includes a step of outputting a list of defective nozzles to a computer.

14. The method of claim 10, said result outputting step includes a step of outputting a list of defective nozzles to a computer.

15. The method of claim 9, said result outputting step comprises providing the list on a liquid crystal display panel.

16. The method of claim 9, said result outputting step comprises providing the list on paper.

17. The method of claim 9, said step of storing in said information storing means comprises storing in a non-volatile memory.

* * * * *